US009935379B2

(12) United States Patent
Athley et al.

(10) Patent No.: US 9,935,379 B2
(45) **Date of Patent: *Apr. 3, 2018**

(54) COMMUNICATION SYSTEM NODE COMPRISING A RE-CONFIGURATION NETWORK

(71) Applicant: Telefonaktiebolaget L M Ericsson (PUBL), Stockholm (SE)

(72) Inventors: Fredrik Athley, Kullavik (SE); Sven Petersson, Sävedalen (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 237 days.

This patent is subject to a terminal disclaimer.

(21) Appl. No.: 14/959,339

(22) Filed: Dec. 4, 2015

(65) Prior Publication Data

US 2016/0087347 A1 Mar. 24, 2016

Related U.S. Application Data

(63) Continuation of application No. 13/581,220, filed as application No. PCT/EP2010/052383 on Feb. 25, 2010, now Pat. No. 9,214,720.

(51) Int. Cl.
*H01Q 3/30* (2006.01)
*H01Q 21/24* (2006.01)
(Continued)

(52) U.S. Cl.
CPC ..... *H01Q 21/24* (2013.01); *H01Q 1/246* (2013.01); *H01Q 3/30* (2013.01); *H01Q 21/0006* (2013.01)

(58) Field of Classification Search
CPC ..... H01Q 1/246; H01Q 3/30; H01Q 21/0006
(Continued)

(56) References Cited

U.S. PATENT DOCUMENTS 6,218,987 B1 4/2001 Derneryd et al.
6,496,157 B1 12/2002 Mottier
(Continued)

FOREIGN PATENT DOCUMENTS

CN 1261989 A 8/2000
CN 1353911 A 6/2006
(Continued)

OTHER PUBLICATIONS

Communication dated Aug. 29, 2013, issued in European Patent Application No. 10 707 868.5, 4 pages.
(Continued)

*Primary Examiner* — Andrea Lindgren Baltzell
(74) *Attorney, Agent, or Firm* — Rothwell, Figg, Ernst & Manbeck, P.C.

(57) ABSTRACT

The present invention relates to a node (1) in a wireless communication system, the node (1) comprising at least one antenna (2) which comprises an even number (A) of antenna ports (3, 4, 5, 6), at least four, where each antenna port (3, 4, 5, 6) is associated with a corresponding polarization (P1, P2), beam-width and phase center. The antenna ports (3, 4, 5, 6) are connected to a reconfiguration network (7) which is arranged for pair-wise linear combination of antenna ports (3, 4, 5, 6) of mutually orthogonal polarizations to a number (B) of virtual antenna ports (8, 9), which number (B) is equal to half the number (A) of antenna ports (3, 4, 5, 6). The virtual antenna ports (8, 9) correspond to virtual antennas and are connected to corresponding radio branches (10, 11). The present invention also relates to a corresponding method.

20 Claims, 5 Drawing Sheets

(51) Int. Cl.
*H01Q 1/24* (2006.01)
*H01Q 21/00* (2006.01)

(58) Field of Classification Search
USPC ..... 343/853
See application file for complete search history.

(56) References Cited

U.S. PATENT DOCUMENTS

| | | | |
|---|---|---|---|
| 7,146,170 | B2 | 12/2006 | Davidson |
| 2006/0068848 | A1 | 3/2006 | Shapira et al. |
| 2010/0004022 | A1 | 1/2010 | Lorentzon |
| 2012/0063525 | A1 | 3/2012 | Engstrom et al. |

FOREIGN PATENT DOCUMENTS

| | | | |
|---|---|---|---|
| CN | 101356747 | A | 1/2009 |
| EP | 1 043 803 | A2 | 10/2000 |
| EP | 0 837 567 | B1 | 12/2004 |
| JP | 08-084021 | A | 3/1996 |
| JP | 09-326629 | A | 12/1997 |
| JP | 2008-017098 | A | 1/2008 |
| WO | 200060885 | A1 | 10/2000 |
| WO | 2009152859 | A1 | 12/2009 |
| WO | 2011005162 | A1 | 1/2011 |

OTHER PUBLICATIONS

Office Action dated Jan. 6, 2014, issued in Chinese Patent Application No. 201080064826.4, 7 pages.

Summary of Reason for Refusal and English translation of Pending Claims from an Office Action dated Jan. 21, 2014, in related Japanese patent apln. No. 2012-554225, 7 pages.

International Search Report dated Jan. 27, 2011, in International Application No. PCT/EP2010/052383, 2 pages.

COMMUNICATION SYSTEM NODE COMPRISING A RE-CONFIGURATION NETWORK

CROSS-REFERENCE TO RELATED APPLICATION(S)

This application is a continuation of U.S. application Ser. No. 13/581,220, filed Aug. 24, 2012, which claims the benefit of International Application No. PCT/EP2010/052383, filed on Feb. 25, 2010. The contents of each of the referenced applications are incorporated herein by reference in their entirety.

TECHNICAL FIELD

The present invention relates to a node in a wireless communication system, the node comprising at least one antenna which comprises an even number of antenna ports, the number being at least four, where each antenna port is associated with a corresponding polarization, beam-width and phase center.

The present invention also relates to a method in a wireless communication system node using at least one antenna having an even number of antenna ports, the number being at least four, where the method comprises the step: associating each antenna port with a corresponding polarization, beam-width and phase center.

BACKGROUND

In a node in a wireless communication system, there is sometimes a need for using a node such as a radio base station (RBS) with a main unit (MU) that has fewer base-band branches than the number of radio branches in a radio remote unit (RRU).

One scenario is when antennas and RRU:s deployed for one system should be re-used for another system. This system may be deployed with RBS:s that have MU:s with fewer base-band chains than the number of branches in the deployed RRU:s.

Another scenario is when a system is first deployed using MU:s with relatively few base-band branches, but is expected to be migrated to MU:s with more base-band branches as the system evolves. In order not to be forced to replace already deployed antennas and RRU:s, it may be desirable to use RRU:s with many branches already at the beginning, and later be able to upgrade the system. It is then sufficient to only upgrade the MU:s to more branches along the migration path.

A simple solution is to connect each base band chain to one radio branch, leaving the excessive radio branches unused. Another solution is to connect one base band chain to two or more adjacent radio chains. If these radio chains are connected to antenna elements with the same polarization, the resulting beam will have a narrower beam-width than the individual physical antenna element.

When power amplifiers are used, the solutions described above do not fully utilize the power amplifiers or preserve the beam-width of the antenna element patterns. In order to maximize the total output power, all power amplifiers should be fully utilized. In order to retain the same cell coverage, the resulting beams should have the same beam-width as the individual antenna elements There is thus a desire to take care of the total capacity of a node where there is a connection between a first number of base-band branches and a second number of radio branches or antenna ports, where the second number is higher than the first number.

SUMMARY

The object of the present invention is to provide a node in a wireless communication system where there is a connection between a first number of base-band branches and a second number of radio branches or antenna ports, where the second number is higher than the first number.

Said object is obtained by means of a node in a wireless communication system, the node comprising at least one antenna which comprises an even number of antenna ports, the number being at least four, where each antenna port is associated with a corresponding polarization, beam-width and phase center. Furthermore, the antenna ports are connected to a reconfiguration network which is arranged for pair-wise linear combination of antenna ports of mutually orthogonal polarizations to a number of virtual antenna ports, which number of virtual antenna ports is equal to half the number of antenna ports, The virtual antenna ports correspond to virtual antennas, the virtual antenna ports being connected to corresponding radio branches.

Said object is also obtained by means of a method in a wireless communication system node using at least one antenna having an even number of antenna ports, the number being at least four, where the method comprises the steps: associating each antenna port with a corresponding polarization, beam-width and phase center; and connecting the antenna ports to a reconfiguration network which is used for pair-wise linear combination of antenna ports of mutually orthogonal polarizations to a number of virtual antenna ports. The number of virtual antenna ports is equal to half the number of antenna ports.

According to an example, the reconfiguration network comprises a divider/combiner for each virtual antenna port, each divider/combiner being connected to a corresponding virtual antenna port. Furthermore, there may be a phase shifter for each divider/combiner, each phase shifter being connected to one corresponding antenna port, where the phase shifters are arranged for controlling the polarization of the virtual antennas.

According to another example, the antenna ports may be connected to respective antenna elements that are positioned such that pairs of mutually orthogonally polarized antenna elements are placed in antenna columns.

According to another example, the antenna ports in each pair that is linearly combined in the reconfiguration network are associated with the same phase center. Then, for each polarization in each column, those antenna elements of each column that have the same polarization may be connected to a corresponding antenna port such that the reconfiguration network is arranged to perform pair-wise linear combination of these antenna ports such that the spacing between the phase centers of the virtual antennas is the same as the spacing between the columns.

Alternatively, the antenna ports in each pair that is linearly combined in the reconfiguration network are associated with phase centers that are mutually displaced in at least one dimension. Then, those antenna elements of different columns that have mutually different polarizations may be connected to corresponding antenna port pairs such that the reconfiguration network is arranged to perform pair-wise linear combination of these antenna port pairs such that the spacing between the phase centers of the virtual antenna elements is twice the spacing between the columns in which the antenna elements in the pairs are positioned.

According to another example, the antenna ports are connected to corresponding amplifiers which preferably are positioned in a radio remote unit, RRU.

A number of advantages is obtained by means of the present invention. For example, the present invention provides a means for connecting an N/2-branch MU to an N-branch RRU with full power utilization and unchanged effective beam-width of the resulting virtual antenna elements. The proposed architecture thus maximizes the total output power and gives the same cell shape as if each RRU branch was connected to an MU branch. Furthermore, the proposed architecture supports migration to a combination with as many MU branches as RRU branches solely by a change of parameter settings, without any manual disconnection of RF cables, etc.

BRIEF DESCRIPTION OF THE DRAWINGS

The present invention will now be describe more in detail with reference to the appended drawings, where.

DETAILED DESCRIPTION

Figure 1:
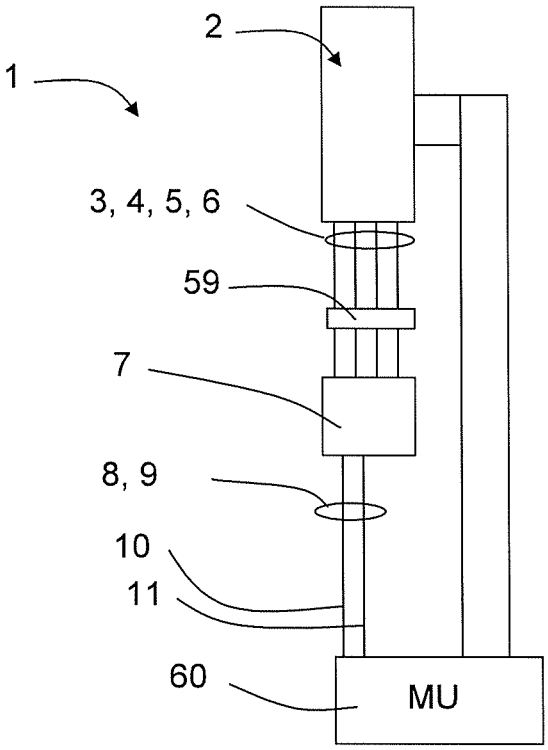
FIG. 1 shows a schematic view of a node according to the present invention.
Figure 2:
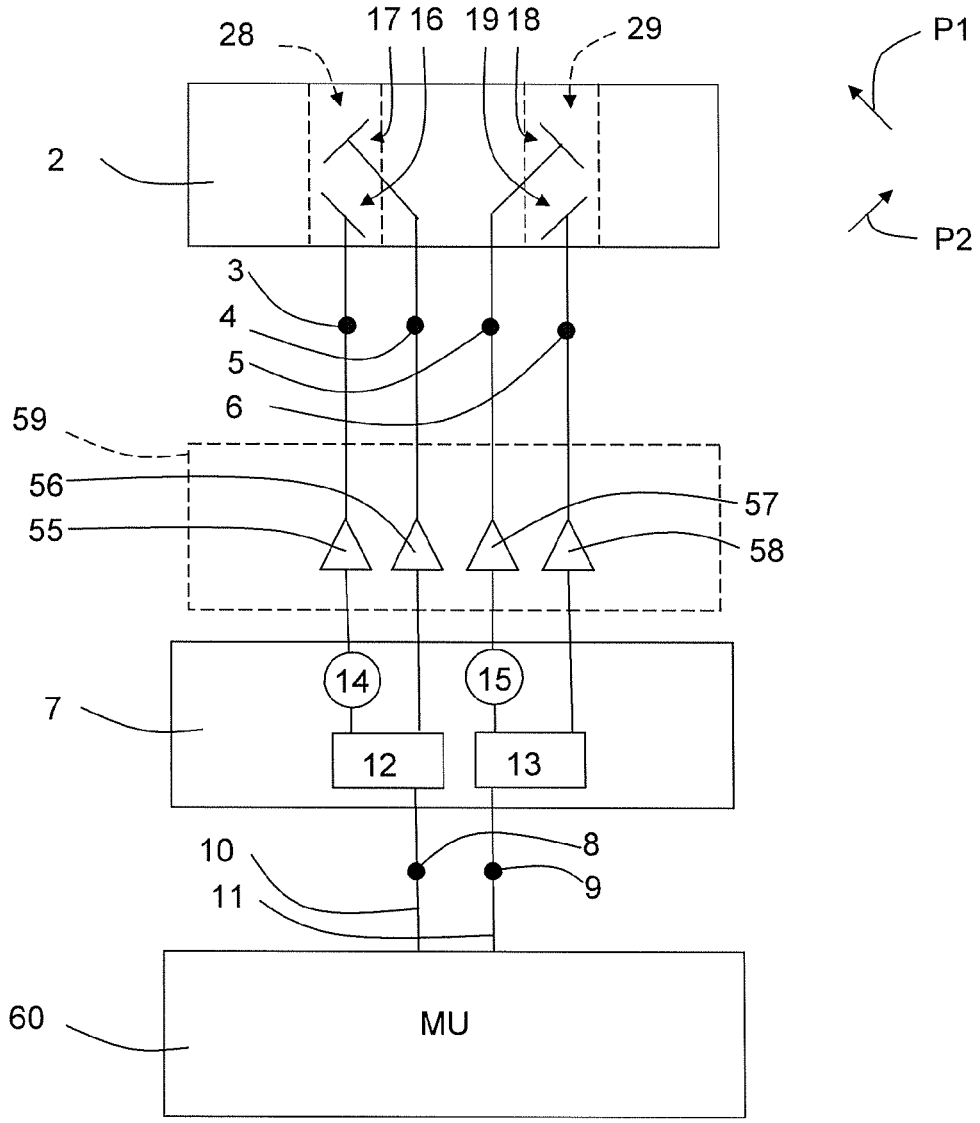
FIG. 2 shows a schematic view of an antenna arrangement and radio chains according to an example of the present invention with four antenna ports.

With reference to FIG. 1 and FIG. 2, there is a node 1 in a wireless communication system, the node 1 comprising an antenna 2 which comprises a first antenna port 3, a second antenna port 4, a third antenna port 5 and a fourth antenna port 6, each antenna port in turn being connected to a corresponding first antenna element 16, second antenna element 17, third antenna element 18 and fourth antenna element 19.

Each antenna element is shown as a single antenna element, but this is only a schematical representation; each antenna element may in fact constitute an antenna element column comprising a number of physical antenna elements. When the term "antenna element" is used below, it should be understood that it may refer to a single antenna element, as shown in FIG. 2, or a number of antenna elements in an antenna element column.

The first antenna element 16 and the second antenna element 17 are positioned in a first antenna column 28, and the third antenna element 18 and fourth antenna element 19 are positioned in a second antenna column 29. Furthermore, the first antenna element 16 and the third antenna element 18 have a first polarization P1 and the second antenna element 17 and the fourth antenna element 19 have a second polarization P2, where the first polarization P1 and the second polarization P2 are essentially orthogonal. This means that the orthogonality is not mathematically exact, but the orthogonality exists to a practical extent.

Thus the first antenna element 16 and the second antenna element 17 are mutually orthogonally polarized, and the third antenna element 18 and the fourth antenna element 19 are mutually orthogonally polarized.

The first antenna element 16 and the second antenna element 17 are shown displaced along the first column 28, which means that they have different phase centers. It is of course conceivable that they are positioned such that they have the same phase center. The same is valid for the third antenna element 18 and the fourth antenna element 19.

This results in that each antenna port 3, 4, 5, 6 is associated with a corresponding polarization P1, P2, beam-width and phase center.

According to the present invention, the antenna ports 3, 4, 5, 6 are connected to a reconfiguration network 7 which is arranged for pair-wise linear combination of antenna ports 3, 4, 5, 6 of essentially mutually orthogonal polarizations to two virtual antenna ports 8, 9. The virtual antenna ports 8, 9 correspond to virtual antennas, and are connected to corresponding radio branches 10, 11. These branches are in turn connected to a main unit (MU) 60.

The effect of the reconfiguration network 7 is that new, virtual, antenna elements are created by a linear combination of physical antenna elements. In this particular example, it means that the first antenna port 3 and the second antenna port 4 are pair-wise combined in the reconfiguration network 7 by means of a first divider/combiner 12 connected to the first antenna port 3 and the second antenna port 4. The first antenna port 3 is connected to the first divider/combiner 12 by means of a first phase shifter 14. In the same way, the third antenna port 5 and the fourth antenna port 6 are pair-wise combined in the reconfiguration network 7 by means of a second divider/combiner 13 connected to the third antenna port 5 and the fourth antenna port 6. The third antenna port 5 is connected to the second divider/combiner 13 by means of a second phase shifter 15. Each divider/combiner is connected to a corresponding virtual antenna ports 8, 9.

By means of the phase shifters 14, 15, the polarization of the virtual antenna ports 8, 9 can be controlled.

By means of the present invention, the beam-width of the virtual antenna elements obtained by combining multiple antenna ports is the same as the beam-width of an individual antenna element.

As shown in FIG. 2, and denoted with dashed lines, the node 1 also comprises a so-called remote radio unit (RRU) 59, which is connected between the antenna ports 3, 4, 5, 6 and the reconfiguration network 7 and comprises corresponding amplifiers 55, 56, 57, 58. This is a simplified drawing of an RRU where only the transmitter chains (TX) are shown, there may also be not shown receiver chains (RX), since the antenna 2 may work reciprocally within the frame of the present invention.

When an RRU or a similar amplifier arrangement is used, the reconfiguration network 7 should be designed so that all amplifiers 55, 56, 57, 58 in the transmitter chains are fully utilized.

Then using an RRU, the general idea is to, in the RRU 59, connect each baseband branch to multiple radio branches in such a way that the amplifiers 55, 56, 57, 58 are fully utilized.

The characteristics in uplink using the new, virtual, element will be the same as if a new physical element with characteristics (polarization, beam-width etc) identical to the virtual element were connected to one of the receiver branches, the other remaining unused. Similarly on downlink, except that the power resource is doubled for the virtual element since two amplifiers are utilized.

The polarization characteristics for the virtual antenna elements depend on the spatial location of the antenna elements, the polarization of the antenna elements and relative phase and amplitude between the antenna ports that are combined. It is assumed that the amplitude is the same for both paths since it is desired to utilize the power resource on downlink.

In the following, the invention will be described for an 8-branch RRU with a 4-branch MU, but the concept is easily generalized to an N-branch RRU with an N/2-branch MU, for any integer N. The antenna is assumed to have N/2 dual-polarized antenna elements with pair-wise orthogonal polarizations.

Figure 3:
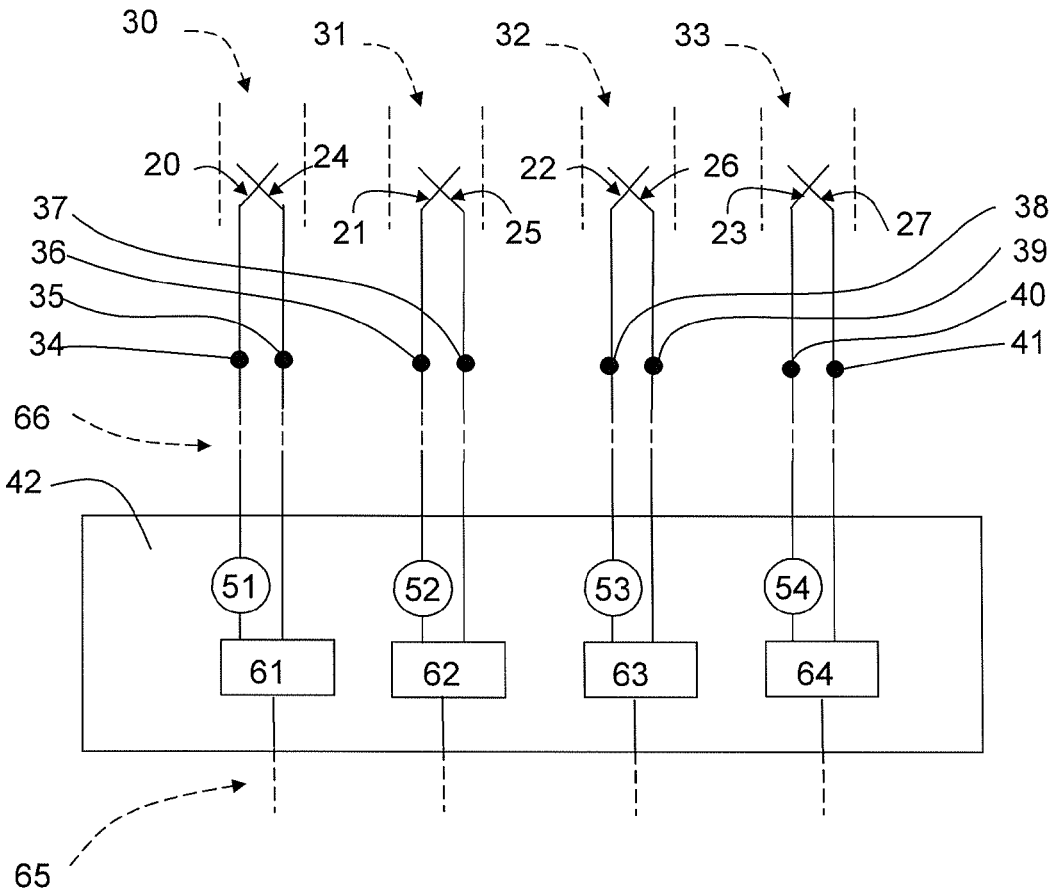
FIG. 3 shows a schematic view of an antenna arrangement and radio chains according to an example of the present invention with eight antenna ports.

One example of the present invention is shown in FIG. 3, where here are four antenna columns 30, 31, 32, 33, each antenna column comprising two orthogonally polarized antenna elements 20, 24; 21, 25; 22, 26; 23, 27 having slanted polarization of ±45°. The antenna elements 20, 24; 21, 25; 22, 26; 23, 27 are connected to corresponding antenna ports 34, 35, 36, 37, 38, 39, 40, 41.

More in detail, for each polarization in each column, those antenna elements 20, 24; 21, 25; 22, 26; 23, 27 of each column 30, 31, 32, 33 that have the same polarization are connected to a corresponding antenna port 34, 35, 36, 37, 38, 39, 40, 41. The antenna ports are connected to the reconfiguration network 42 such that it performs pair-wise linear combination of these antenna ports 34, 35, 36, 37, 38, 39, 40, 41 such that the spacing between the phase centers of the virtual antennas is the same as the spacing between the columns.

The resulting polarization for the virtual antenna elements depends on a relative phase angle $\beta_k$, where k denotes a virtual element number, between the corresponding pairs, which phase is adjusted by means of phase shifters 51, 52, 53, 54 comprised in the reconfiguration network 42, the phase shifters 51, 52, 53, 54 being connected to one antenna port 34, 36, 38, 40 of each pair of antenna ports. The phase shifters 51, 52, 53, 54 and the other antenna port 35, 37, 39, 41 are pair-wise connected to corresponding dividers/combiners 61, 62, 63, 64 comprised in the reconfiguration network 42, which dividers/combiners 61, 62, 63, 64 in turn are connected to virtual antenna ports, here only denoted with dashed lines 65.

Furthermore, the connections between the antenna ports 34, 35, 36, 37, 38, 39, 40, 41 and the reconfiguration network 42 are shown with dashed lines 66, indicating the possible presence of an RRU as discussed with reference to FIG. 1 and FIG. 2.

Since the antenna elements 20, 24; 21, 25; 22, 26; 23, 27 have slanted polarizations of ±45°, the virtual antenna elements can take any polarization, depending on $\beta_k$, from linear horizontal, elliptical with major axis being horizontal, circular, and elliptical with major axis being vertical to linear vertical.

For example, the phase angles $\beta_k$ may be selected to make the virtual antennas of the first two columns 30, 31 vertically polarized and the virtual antennas of the last two columns 32, 33 horizontally polarized. Since elements with, at least almost, orthogonal polarizations are combined, the virtual elements will have the same beam shape, and thus the same beam-width, for the power pattern as the individual elements. The polarization will however be affected, as already mentioned. In this example, there are two groups of virtual elements, the groups having orthogonal polarizations. The spacing between the phase centers of the virtual elements within a group is the same as the column spacing, while the two groups are dislocated by a distance twice the column spacing. As a consequence, a beam generated via the array of virtual elements will have a polarization that depends on the azimuth angle since the difference in electrical phase angle between the two groups depends on azimuth spatial angle.

Note that the same phase angle $\beta_k$ shall be applied in both the RX and the TX branches within each RX/TX pair for the virtual element to have the same polarization on uplink and downlink. The phase angle $\beta_k$ may have one certain value per pair of orthogonal antenna elements, defining the polarization, and should preferably be easy to change if desired.

As shown with reference to FIG. 2, and discussed previously, the first antenna element 16 and the second antenna element 17 are shown displaced along the first column 28, which means that they have different phase centers, and the same is the case for the third antenna element 18 and the fourth antenna element 19. This means that the antenna ports (3, 4; 5, 6) in each pair that is linearly combined in the reconfiguration network (7) are associated with phase centers that are mutually displaced in dimension; along the columns 28, 29. Generally, the antenna ports may be associated with phase centers that are mutually displaced in at least one dimension.

Figure 4:
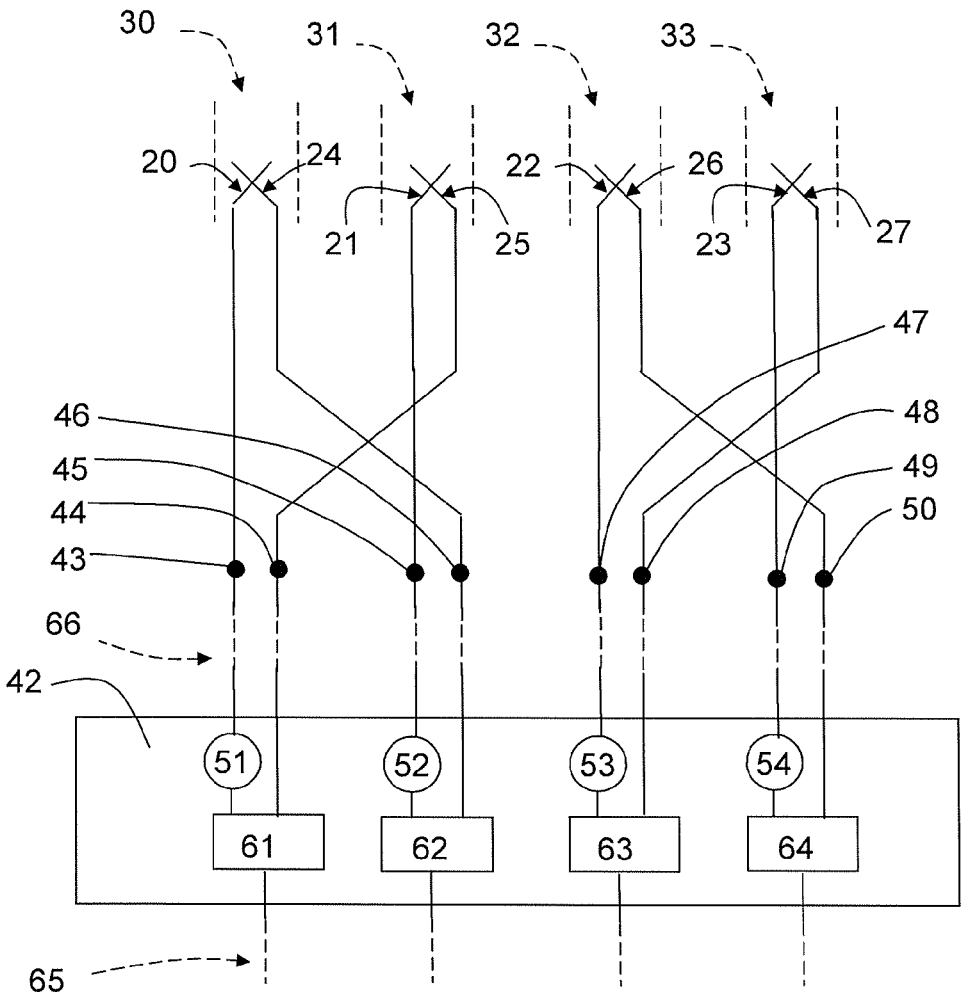
FIG. 4 shows a schematic view of an antenna arrangement and radio chains according to another example of the present invention with eight antenna ports.

This is illustrated in another example with reference to FIG. 4, where spatially separated antenna elements of orthogonal polarization are connected to form a virtual element. Those elements that are similar to the ones of the previous example have the same reference numbers.

Here, those antenna elements 20, 25; 24, 21; 22, 27; 26, 23 of different columns 30, 31, 32, 33 that have mutually different polarizations are connected to corresponding antenna port pairs 43, 44; 46, 45; 47, 48; 50, 49 such that the reconfiguration network 42 is arranged to perform pair-wise linear combination of these antenna port pairs 43, 44; 46, 45; 47, 48; 50, 49 such that the spacing between the phase centers of the virtual antenna elements is twice the spacing between the columns in which the antenna elements 20, 25; 24, 21; 22, 27; 26, 23 in the pairs are positioned.

More in detail, the antenna elements 20, 25; 24, 21 of the first two antenna columns 30, 31 that have orthogonal polarizations are connected to a first antenna port pair 43, 44 and a second antenna port pair 46, 45. In the same way, the antenna elements 22, 27; 26, 23 of the other two antenna columns 32, 33 that have orthogonal polarizations are connected to a first antenna port pair 47, 48 and a second antenna port pair 50, 49.

As in the previous example with reference to FIG. 3, the resulting polarization for the virtual antenna elements depends on a relative phase angle $\beta_k$, where k denotes a virtual element number, between the corresponding pairs, which phase is adjusted by means of phase shifters 51, 52, 53, 54 comprised in the reconfiguration network 42, the phase shifters 51, 52, 53, 54 being connected to one antenna port 43, 45, 47, 49 of each pair of antenna ports. The phase shifters 51, 52, 53, 54 and the other antenna port 44, 46, 48, 50 are pair-wise connected to corresponding dividers/combiners 61, 62, 63, 64 comprised in the reconfiguration network 42, which dividers/combiners 61, 62, 63, 64 in turn are connected to virtual antenna ports, here only denoted with dashed lines 65.

Furthermore, the connections between the antenna ports 43, 44, 45, 46, 47, 48, 49, 50 and the reconfiguration network 42 are shown with dashed lines 66, indicating the possible presence of an RRU as discussed with reference to FIG. 1 and FIG. 2.

Thus, in this example with reference to FIG. 4, the spacing between the phase centers of the obtained virtual antenna elements with same polarization will be twice the column distance, while a pair of virtual antenna elements with different polarizations will have the same phase center. The virtual antenna elements will, due to the spatial separation of physical elements, have a polarization that changes with spatial azimuth angle.

Figure 5:
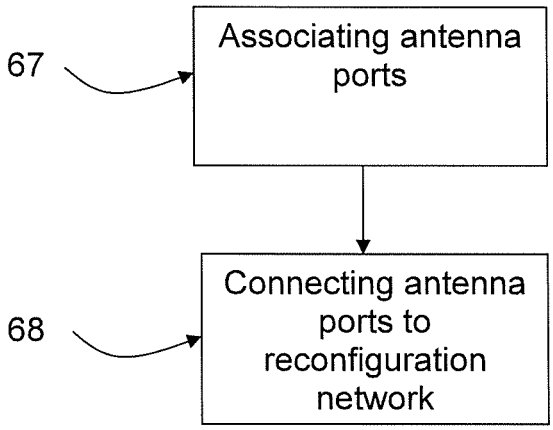
FIG. 5 shows a flowchart for a method according to the present invention.

The two examples with reference to FIG. 4 and FIG. 5 both disclose an array antenna having virtual elements of orthogonal polarizations for certain selected values of the phase angles $\beta_k$. However, the array of virtual elements will differ in some aspects compared to a "conventional" dual column, dual polarized, array antenna. For the array in FIG. 3, the virtual elements with vertical and horizontal polarization respectively will be spatially separated from each other, whereas the polarization for each virtual element will be the independent of spatial direction if ideal antenna elements are assumed. For the array in FIG. 4, the virtual elements will have the same spatial location but the polarization will depend on spatial azimuth angle. In both cases, a beam formed over the array of virtual elements will have a polarization that is dependent on the azimuth angle.

Generally, the dividers/combiners 12, 13; 61, 62, 63, 64 perform signal splitting, duplication, in downlink and combination, summation, in uplink. The operation may be performed in the digital domain. The network also has the functionality of applying a radio branch specific phase shift for purposes of controlling the polarization of the virtual antenna elements.

The polarization characteristics for the virtual antenna elements will depend on which antenna elements that are combined, the polarization characteristics for the antenna elements and the phase/amplitude relation between the pairs of antenna ports. The antenna elements are identical on transmit and receive and thus work reciprocally. Although not necessary for the present invention, it is possible to obtain reciprocal virtual antenna elements. For the virtual elements to be reciprocal, the reconfiguration network 7, 42 must fulfill certain characteristics:

1. The same pair of, physical, antenna elements being connected to a baseband branch on uplink must also be connected on downlink.
2. The relation between transfer functions on receive, for the pairs of antenna ports connected to the same physical element, must be the same as on transmit.

The requirement in paragraph (2) is needed to have identical polarization for a virtual antenna element on uplink and downlink. Having identical polarization is important if one wants to exploit reciprocity. For configurations where reciprocity is not an issue, the proposed architecture allows for having different polarizations on uplink and downlink if that is desired. To ensure that radio chains meet the coherency requirements from paragraph (2), calibration is most likely needed.

The present invention also relates to a method. With reference to FIG. 5, the method relates to a wireless communication system node using at least one antenna 2 having an even number A of antenna ports 3, 4, 5, 6, the number being at least four, where the method comprises the steps:

67: associating each antenna port 3, 4, 5, 6 with a corresponding polarization P1, P2, beam-width and phase center, and

68: connecting the antenna ports 3, 4, 5, 6 to a reconfiguration network 7 which is used for pair-wise linear combination of antenna ports 3, 4, 5, 6 of essentially mutually orthogonal polarizations to a number (B) of virtual antenna ports 8, 9, which number B of virtual antenna ports 8, 9 is equal to half the number A of antenna ports 3, 4, 5, 6.

The present invention is not limited to the examples discussed above, but may vary freely within the scope of the appended claims.

Other possible but not necessary requirements of the reconfiguration network are:

1. For flexibility—the possibility of different virtual antenna configurations—and migration purposes, the network may be reconfigurable:

2.

Any baseband branch shall be able to connect to any pair of uplink/downlink antenna ports.

Any baseband branch shall be able to connect to any single uplink/downlink antenna port.

3. The phase relation between pairs of transmit and pairs of receive antenna ports shall be reconfigurable for creating a desired virtual element polarization.

The node according to the present invention may comprise virtual antenna elements that work reciprocally, but this is not a requirement. In fact, the node may only be suited for transmission or reception, where an optional RRU than is equipped for handling the desired functionality. Of course, the RRU may be equipped for handling a node that is suited for both transmission and reception, and thus works for uplink as well as downlink.

The reconfiguration network 7, 42 may be standalone, comprised in the RRU or comprised in the MU. In any case, the reconfiguration network 7, 42 may be realized in hardware as well as software, or a combination.

The present invention may support adjustments by solely change of parameter settings, i.e., no manual disconnection of RF cables etc. should be needed.

Generally, the number B of virtual antenna ports 8, 9 is equal to half the number A of antenna ports 3, 4, 5, 6.

When antenna elements are indicated to have mutually orthogonal polarizations, or essentially mutually orthogonal polarizations, in this context this is not meant as those polarizations being mathematically exactly orthogonal, but orthogonal to an extent of what is practically possible to achieve in this field of technology. The same is the case when the spacing between the phase centers of the virtual antennas is indicated to be the same as the spacing between the columns, where this should be interpreted to be valid to an extent of what is practically possible to achieve in this field of technology.

The invention claimed is:

1. A node in a wireless communication system, the node comprising at least one antenna, where the at least one antenna comprises an even number of antenna ports, the number being at least four, where each antenna port is associated with a corresponding polarization, beam-width and phase center, wherein the antenna ports are connected to a reconfiguration network which is arranged for pair-wise linear combination of antenna ports of mutually orthogonal polarizations to a number of virtual antenna ports, wherein each virtual antenna port is connected by the reconfiguration network to a pair of the antenna ports and each antenna port is connected by the reconfiguration network to a single virtual antenna port, where the virtual antenna ports correspond to virtual antennas, the virtual antenna ports being connected to corresponding radio branches.

2. A node according to claim 1, wherein the reconfiguration network comprises a divider/combiner for each virtual antenna port, each divider/combiner being connected to a corresponding virtual antenna port.

3. A node according to claim 2, further comprising a phase shifter for each divider/combiner, each phase shifter being connected to one corresponding antenna port, where the phase shifters are arranged for controlling the polarization of the virtual antennas.

4. A node according to claim 1, wherein the antenna ports are connected to respective antenna elements that are positioned such that pairs of mutually orthogonally polarized antenna elements are arranged in antenna columns.

5. A node according to claim 1, wherein the antenna ports in each pair that is linearly combined in the reconfiguration network are associated with the same phase center.

6. A node according to claim 5, wherein for each polarization in each column, those antenna elements of each column that have the same polarization are connected to a corresponding antenna port such that the reconfiguration network is arranged to perform pair-wise linear combination of these antenna ports such that the spacing between the phase centers of the virtual antennas is the same as the spacing between the columns.

7. A node according to claim 1, wherein the antenna ports in each pair that is linearly combined in the reconfiguration network are associated with phase centers that are mutually displaced in at least one dimension.

8. A node according to claim 7, wherein those antenna elements of different columns that have mutually different polarizations are connected to corresponding antenna port pairs such that the reconfiguration network is arranged to perform pair-wise linear combination of these antenna port pairs such that the spacing between the phase centers of the virtual antenna elements is twice the spacing between the columns in which the antenna elements in the pairs are positioned.

9. A node according to claim 1, wherein the antenna ports are connected to corresponding amplifiers.

10. A node according to claim 9, wherein the amplifiers are positioned in a radio remote unit, RRU.

11. A method in a wireless communication system node using at least one antenna having an even number of antenna ports, the number being at least four, comprising:

associating each antenna port with a corresponding polarization, beam-width and phase center; and connecting the antenna ports to a reconfiguration network which is used for pair-wise linear combination of antenna ports of mutually orthogonal polarizations to a number of virtual antenna ports, wherein each virtual antenna port is connected by the reconfiguration network to a pair of the antenna ports and each antenna port is connected by the reconfiguration network to a single virtual antenna port.

12. A method according to claim 11, wherein the reconfiguration network comprises a divider/combiner for each virtual antenna port, and the method further comprises connecting each divider/combiner to a corresponding virtual antenna port.

13. A method according to claim 12, wherein each divider/combiner comprises a phase shifter, and the method further comprises:

connecting each phase shifter to one corresponding antenna port; and arranging each phase shifter for controlling the polarization of the virtual antennas.

14. A method according to claim 11, further comprising connecting the antenna ports to respective antenna elements that are positioned such that pairs of mutually orthogonally polarized antenna elements are arranged in antenna columns.

15. A method according to claim 11, further comprising associating the antenna ports in each pair that is linearly combined in the reconfiguration network with the same phase center.

16. A method according to claim 15, further comprising, for each polarization in each column, connecting those antenna elements of each column that have the same polarization to a corresponding antenna port such that the reconfiguration network is arranged to perform pair-wise linear combination of these antenna ports such that the spacing between the phase centers of the virtual antennas is the same as the spacing between the columns.

17. A method according to claim 11, further comprising associating the antenna ports in each pair that is linearly combined in the reconfiguration network with phase centers that are mutually displaced in at least one dimension.

18. A method according to claim 17, further comprising connecting those antenna elements of different columns that have mutually different polarizations to corresponding antenna port pairs such that the reconfiguration network is arranged to perform pair-wise linear combination of these antenna port pairs such that the spacing between the phase centers of the virtual antenna elements is twice the spacing between the columns in which the antenna elements in the pairs are positioned.

19. A method according to claim 11, further comprising connecting the antenna ports to corresponding amplifiers.

20. A method according to claim 19, further comprising positioning the amplifiers in a radio remote unit, RRU.

* * * * *